US006659893B1

(12) United States Patent
Campbell et al.

(10) Patent No.: US 6,659,893 B1
(45) Date of Patent: Dec. 9, 2003

(54) VOLLEYBALL TRAINING APPARATUS

(75) Inventors: Douglas B. Campbell, Loretto, MN (US); Jeffery J. Campbell, Lonsdale, MN (US)

(73) Assignee: Airborne Athletics, Inc., Belle Plaine, MN (US)

( * ) Notice: Subject to any disclaimer, the term of this patent is extended or adjusted under 35 U.S.C. 154(b) by 0 days.

(21) Appl. No.: 09/887,542

(22) Filed: Jun. 22, 2001

(51) Int. Cl.[7] ..... A63B 69/38
(52) U.S. Cl. ..... 473/459; 473/471
(58) Field of Search ..... 473/459, 462, 473/432, 435, FOR 212; 273/397

(56) References Cited

U.S. PATENT DOCUMENTS 1,371,867 A * 3/1921 Dean ..... 273/397
4,693,472 A * 9/1987 Newman et al. ..... 473/435
5,062,646 A * 11/1991 Crist ..... 473/432
5,472,212 A * 12/1995 Bercaw ..... 473/462
5,827,137 A * 10/1998 Ishino ..... 473/459

* cited by examiner

*Primary Examiner*—Paul T. Sewell
*Assistant Examiner*—M. Chambers

(74) *Attorney, Agent, or Firm*—Kinney & Lange, P.A.

(57) ABSTRACT

A collapsible frame supports a first and second net useful for practicing various volleyball maneuvers. The first net is attached such that it acts as a standard volleyball net and the second net is attached behind the first net such that it catches and holds volleyballs hit over the first net. The entire apparatus can be disassembled making it convenient for storing and portable to any desired location.

28 Claims, 8 Drawing Sheets

VOLLEYBALL TRAINING APPARATUS

CROSS-REFERENCE TO RELATED APPLICATION(S)

None.

BACKGROUND OF THE INVENTION

The present invention relates to a volleyball apparatus, and in particular to a training apparatus used for volleyball practice.

Members of a volleyball team must practice several ball-striking moves to hone skills. Some practice is acquired during team practices, but many times further practice is required whereby drills are carried out. In these instances, the balls become strewn throughout the court and the practicing individual or others must retrieve the balls, which wastes time. This method of practice also wastes gymnasium space since only one or two players are benefitting from the court time. In addition, players are confined to only practice where the volleyball court is set up in the gymnasium.

Other training devices were previously described such as in Crist, U.S. Pat. No. 5,062,646. This apparatus, however, is fixed to a wall preventing it from being portable. Even though the Crist device is collapsible, it can not be completely removed from the gymnasium and stored in another convenient location.

BRIEF SUMMARY OF THE INVENTION

The invention is a volleyball training apparatus. The apparatus has a frame with front and back support members that extend vertically. A first net is attached to and extends between the front support members. A second net is attached to and extends between the back support members and creates a pocket behind the first net.

BRIEF DESCRIPTION OF THE DRAWINGS

FIG. 1*a* is the training apparatus with the second net removed.

DETAILED DESCRIPTION

Figure 1A:
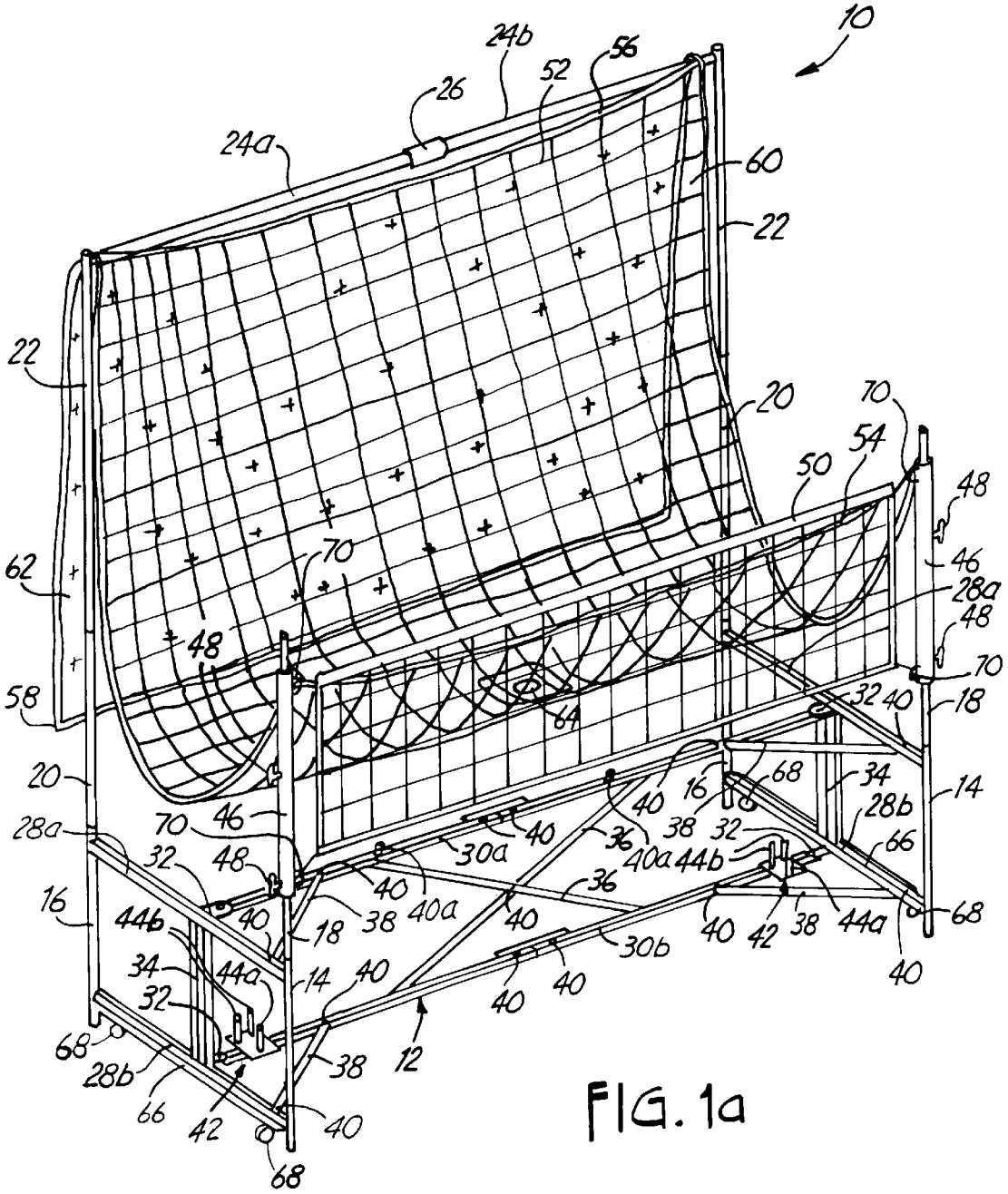
FIG. 1*a* is one embodiment of the volleyball training apparatus invention.

FIG. 1*a* shows the preferred embodiment of training apparatus 10. Training apparatus 10 includes frame 12 (formed by front posts 14, back posts 16, front poles 18, back poles 20 and 22, net stabilizers 24*a* and 24*b*, coupler 26, end bars 28*a* and 28*b*, cross bars 30*a* and 30*b*, hinges 32, supports 34, cross stabilizers 36, stabilizing bars 38, fasteners 40, pole mounts 42 with pegs 44*a* and 44*b*, sleeves 46, and set screws 48), first net 50, second net 52 (with edges 54, 56, and 58, and panels 60 and 62), ball release 64, wheel supports 66, and wheels 68.

Front posts 14 and back posts 16 are located at each comer of frame 12. Front poles 18 stack on front posts 14, back poles 20 stack on back posts 16, and back poles 22 stack on back poles 20. Net stabilizers 24*a* and 24*b* attach at the tops of back poles 22. Coupler 26 connects net stabilizers 24*a* and 24*b*. End bars 28*a* and 28*b* extend from front posts 14 to back posts 16. Cross bar 30*a* extends between end bars 28*a*, cross bar 30*b* extends between end bars 28*b*. Cross bars 30*a* and 30*b* are attached to end bars 28*a* and 28*b* by hinges 32. Supports 34 extend vertically between and attach to end bars 28*a* and 28*b*. Cross stabilizers 36 extend diagonally between cross bars 30*a* and 30*b* and intersect with each other. Stabilizing bars 38 extend diagonally between end bar 28*a* and cross bar 30*a* and end bar 28*b* and cross bar 30*b*. Stabilizing bars 38 may extend toward the front or back of frame 12 from either side of cross bars 30*a* and 30*b*. Fasteners 40 secure connections between each of the components. Pole mounts 42 are attached to cross bar 30*b*. Pegs 44*a* and 44*b* extend vertically from pole mounts 42. Sleeves 46 slide over front poles 18, and set screws 48 fix sleeves 46 to front poles 18.

First net 50 attaches to eyes (or loops) 70 at the top and bottom of sleeves 46 and extends between them. Second net 52 attaches at the ends of edge 54 to eyes 70 at the top of sleeves 46; ends of edge 56 attach to net stabilizers 24*a* and 24*b* near the attachment to back poles 22; and edge 58 remains unattached on the backside of frame 12. Panel 60 of second net 52 hangs loosely between front poles 18 and back poles 20 and 22, such that second net 52 forms a large pocket behind first net 50. Panel 62 drapes behind panel 60. Ball release 64 is located within the pocket of panel 60 of second net 52. Wheel supports 66 connect to end bars 28*b* and support wheels 68.

When in use, training apparatus 10 is set up as shown and can be positioned on any suitable surface. The height of first net 50 is adjusted by moving sleeves 46 up or down along front poles 18. Sleeves 46 are secured in the desired position by tightening set screws 48. First net 50 can be set to an adjustable height such as from about six feet to over nine feet.

Figure 1B:
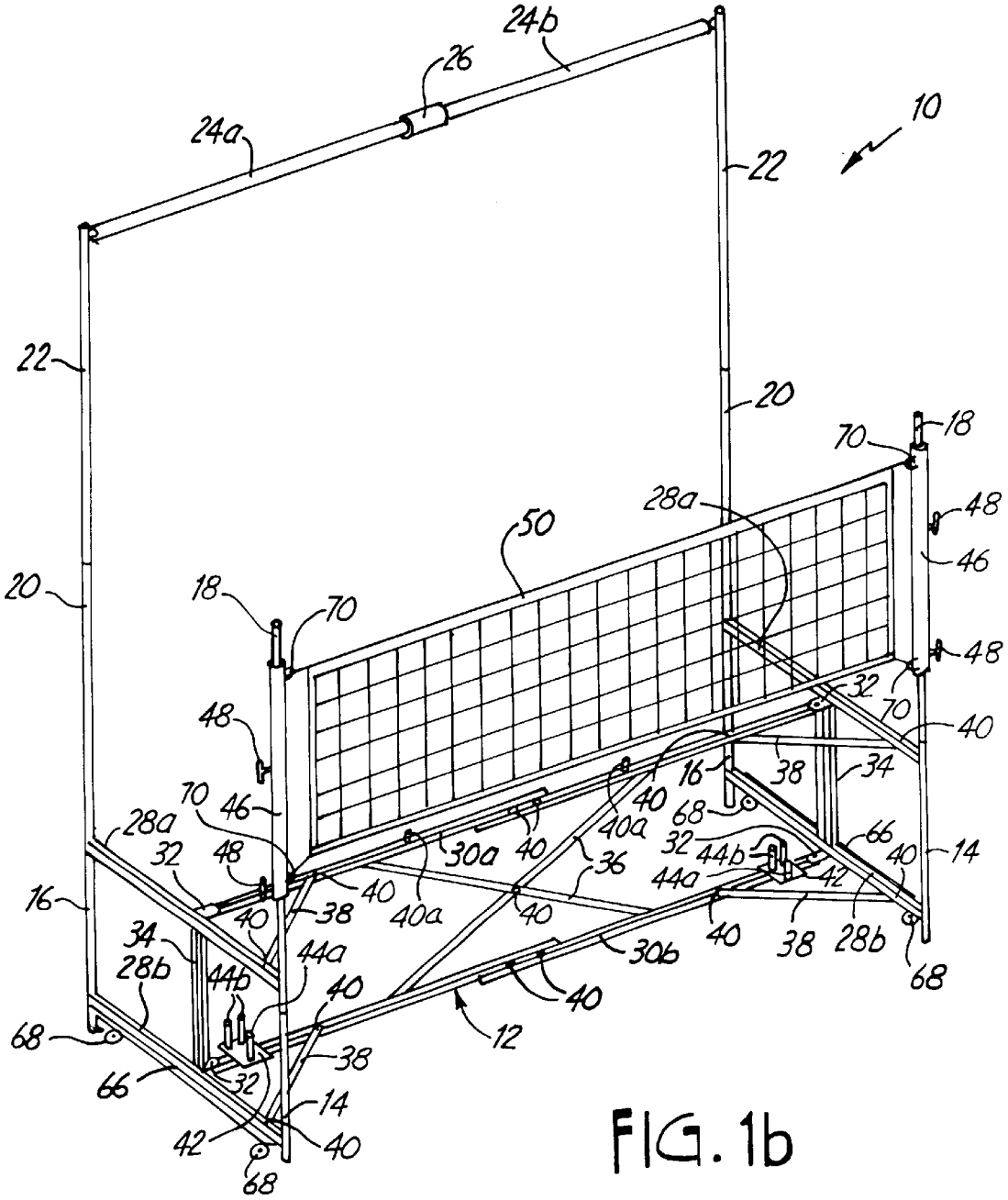

FIG. 1*b* shows training apparatus 10 with second net 52 removed. This provides a simpler view of apparatus 10 in the course of assembly or disassembly.

Figure 2:
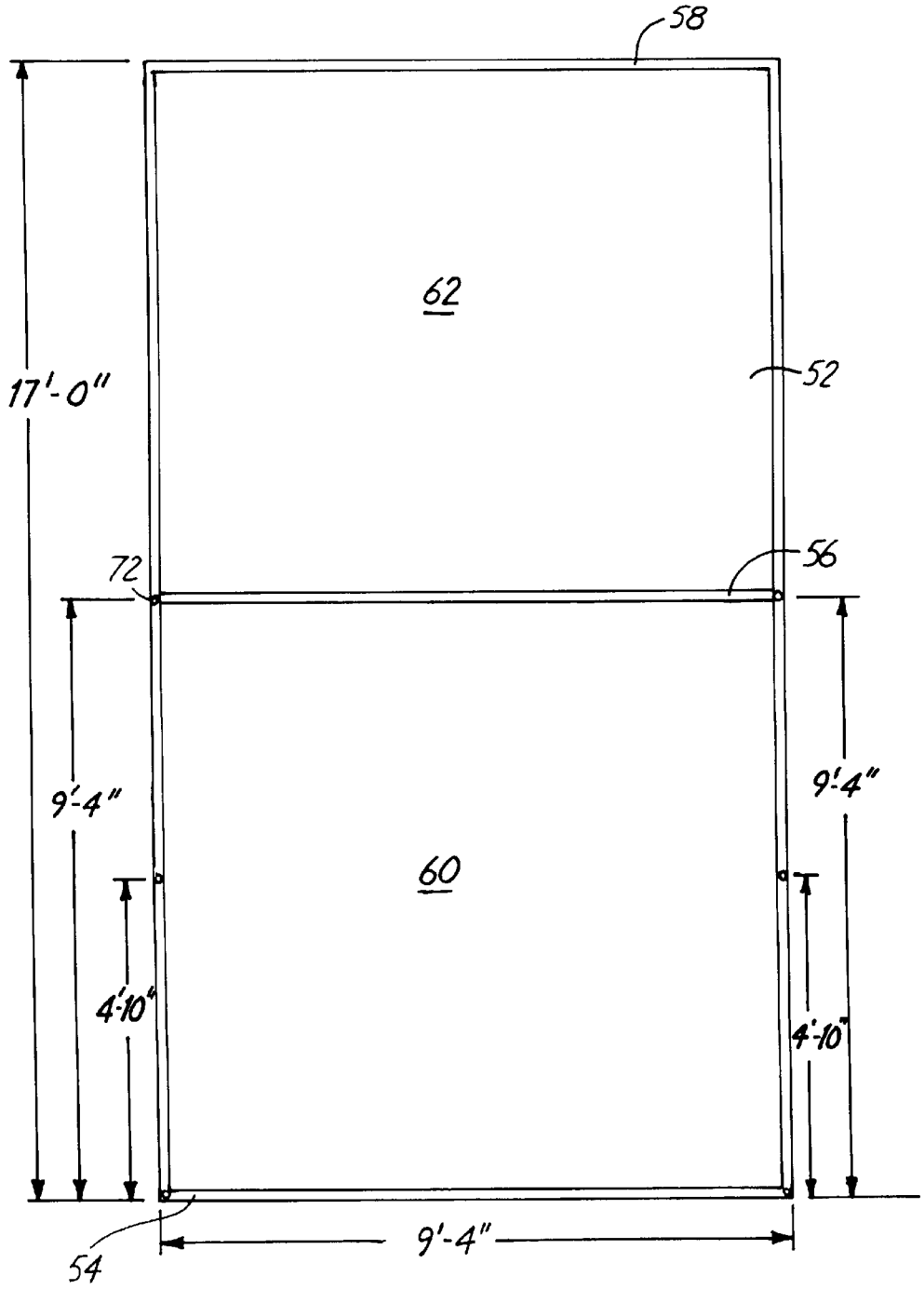
FIG. 2 shows the second net of FIG. 1*a*.

FIG. 2 is the preferred embodiment of second net 52. Second net 52 includes edges 54, 56, and 58, panels 60 and 62, and position 72. Second net 52 is about 9 feet 4 inches wide and about 17 feet tall. Edge 56 is positioned about 9 feet 4 inches from edge 54. Edge 56 is positioned on net stabilizers 24*a* and 24*b* (FIG. 1). Position 72 is located about 9 feet 4 inches from edge 54. In an alternate embodiment of the invention second net 52 can be attached to back poles 20 at position 72.

A player practices various shots by hitting a volleyball over first net 50, and training apparatus 10 provides a realistic setting. Second net 52 catches the volleyballs hit over first net 50. Second net 52 is positioned about twelve feet above the ground, so that it will block almost all volleyballs as they are hit over first net 50. The volleyballs come to rest in the pocket formed by panel 60 of second net 52. Edge 54 of second net 52 could be positioned at any height above the floor along front posts 14 and front poles 18 as long as second net 52 is long enough to form a pocket within panel 60 for catching and keeping the volleyballs. The pocket can also be formed from two separate nets instead of one single net. Volleyballs are easily retrieved from the pocket of second net 52.

Ball release 64 makes retrieving volleyballs from the pocket of second net 52 more convenient. In one embodiment, ball release 64 is comprised of a tubular piece of cloth that tapers from a larger opening, attached to second net 52, to a smaller opening, which hangs below the larger opening when loosened to allow volleyballs to drop through, and a drawstring around the smaller opening. When the drawstring cinches the smaller opening closed, the pocket of second net 52 is level. Volleyballs are emptied from the pocket by loosening the drawstring, which allows the tubular cloth to drop down and let volleyballs to pass through.

In a second embodiment, ball release 64 is comprised of a square cloth attached to the pocket of second net 52. The cloth is permanently attached along one side to second net 52 and detachably connected along the remaining sides by Velcro fasteners or some other suitable means. When all sides of ball release 64 are attached, the volleyballs are collected in the pocket of second net 52. To release the volleyballs, the detachable sides are released and the volleyballs will fall through the resulting opening.

Two components of the preferred embodiment of the invention prevent spiked volleyballs from undergoing a slingshot action which propels the volleyball back over first net 50. The first is net stabilizers 24*a* and 24*b* connected by coupler 26. If a volleyball is spiked over first net 50 and into second net 52 without net stabilizers 24*a* and 24*b* with coupler 26, back poles 20 and 22 tend to bow and flex causing second net 52 to act as a slingshot. With net stabilizers 24*a* and 24*b* connected together by coupler 26 attached in place, this effect is greatly reduced. Preferably, net stabilizers 24*a* and 24*b* are made of PVC pipe and the ends are attached to the top of back poles 22 in the following manner. D-loops are attached near the top of back poles 22, and net stabilizers 24*a* and 24*b* have openings, which are perpendicular to the length of the tubes, drilled at one end of each tube. The components are attached by slipping a bolt through the openings of 24*a* and 24*b* and the D-loops on back poles 22 and securing the bolt in place.

The slingshot effect is further reduced by panel 62 of second net 52. Panel 62 drapes behind panel 60, which is the section of second net 52 where the volleyball is hit into. The added netting further prevents the volleyball from being tossed back over first net 50.

Figure 3B:
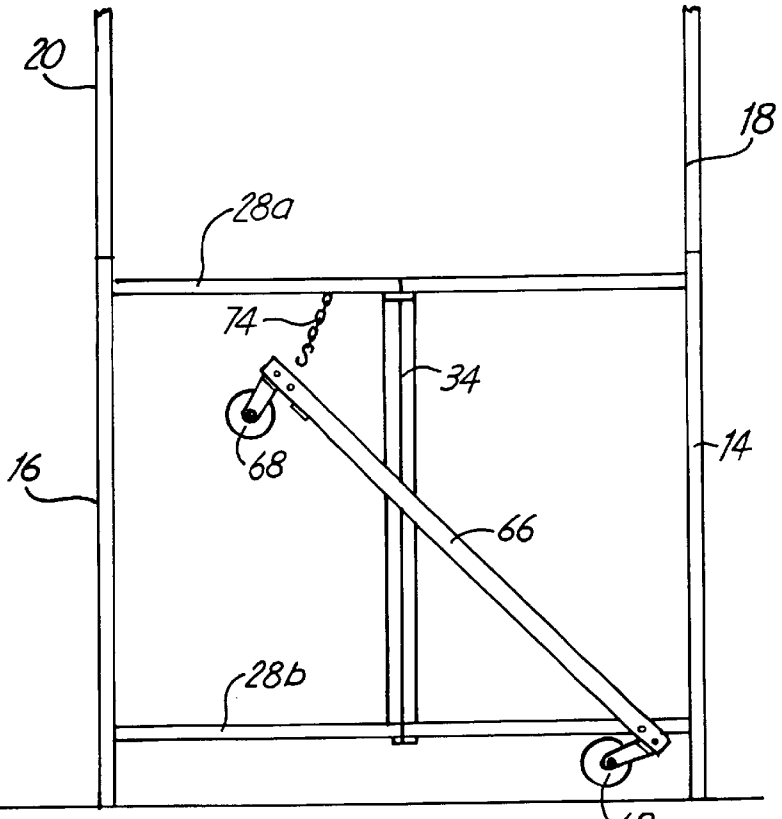
FIGS. 3*a* and 3*b* are end views of the frame showing the preferred positioning of the wheels.
Figure 3A:
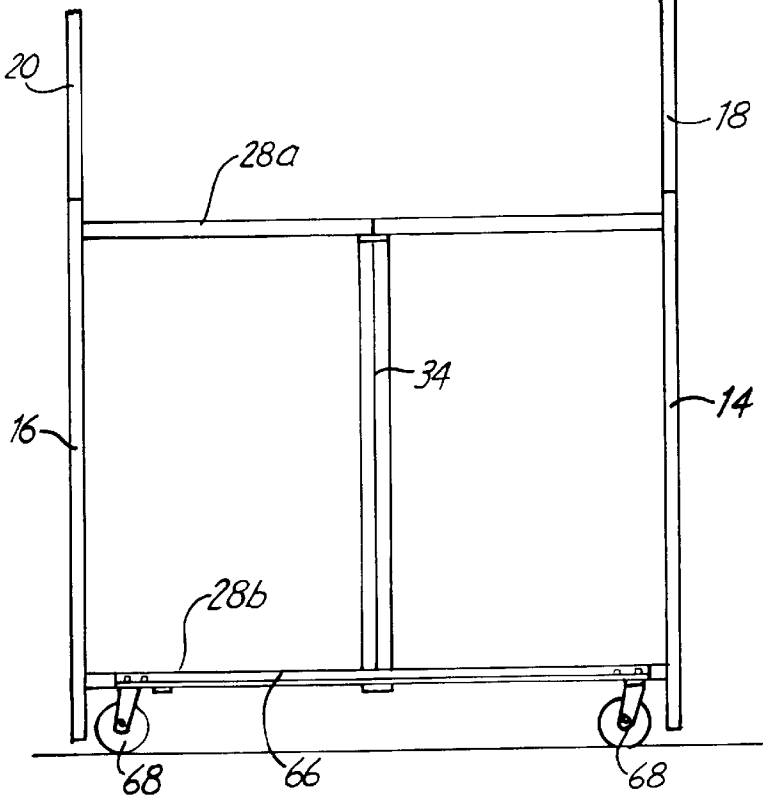

FIGS. 3*a* and 3*b* show the preferred manner of planting apparatus 10 so that it does not roll during use. FIGS. 3*a* and 3*b* include front post 14, back post 16, front pole 18, back pole 20, end bars 28*a* and 28*b*, support 34, wheel support 66, and wheels 68. FIG. 3*b* further includes chain 74.

FIG. 3*a* shows apparatus 10 with wheels 68 positioned such that apparatus 10 is mobile. When wheel support 66 with wheels 68 is locked in a position along side end bar 28*b*, wheels 68 are on the floor and front post 14 and back post 16 are lifted off the floor. Apparatus 10 can be rolled to a desired location.

FIG. 3*b* shows apparatus 10 with wheels 68 positioned such that apparatus 10 is planted on the floor. To operate, one end of wheel support 66 is lifted from the floor and attached to chain 74, which causes the other end of wheel support 66 to pivot relative to end bar 28*b*. In this position, wheels 68 no longer touch the floor and front post 14 and back post 16 now touch the floor. Apparatus 10 is planted in position and will not move during use.

Once practice is finished, training apparatus 10 is collapsible for easy portability and storage. First net 50 and second net 52 are detached from frame 12. Net stabilizers 24*a* and 24*b* with coupler 26 detach from back poles 22 and coupler 26 disconnects net stabilizer 24*a* from 24*b*. Front poles 18 and sleeves 46 are disconnected from front posts 14, and back poles 22 are disconnected from back poles 20, which are in turn disconnected from back posts 16. Front poles 18 are placed on pegs 44*a* and back poles 20 and 22 are placed on pegs 44*b* for storage. Stabilizing bars 38 slide along cross bars 30*a* and 30*b* and attach to pins 40a. This allows end bars 28*a* and 28*b*, front posts 14, and back posts 16 to pivot around hinges 32 such that end bars 28*a* and 28*b* will be essentially parallel to cross bars 30*a* and 30*b*, and frame 12 will be essentially flat. Training apparatus 10 is easily rolled and requires a minimal amount of space for storage. If desired, all fasteners 40 could be removed and the parts disassembled for even more compact storage, however, this requires more time and effort for disassembly and reassembly.

Figure 4A:
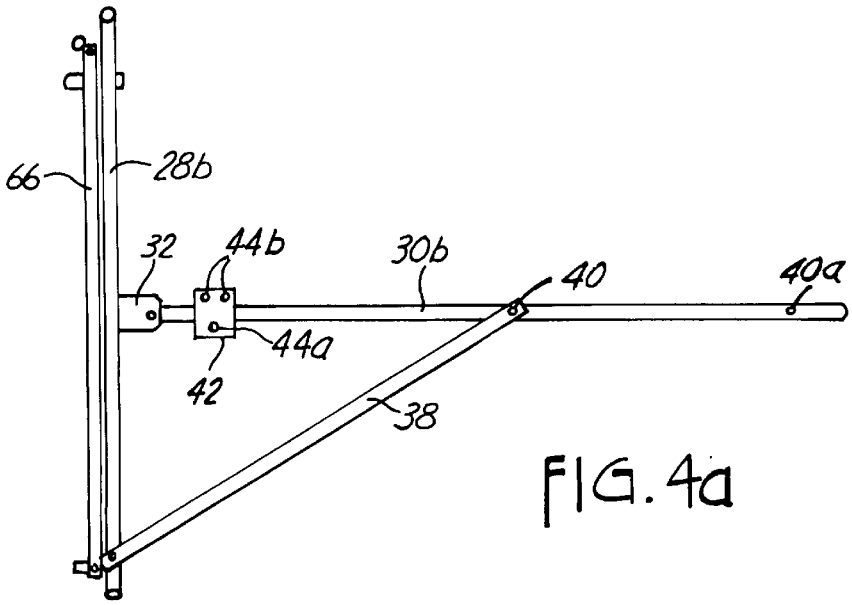
FIGS. 4*a* and 4*b* are top views of the left lower side of the frame showing preferred positions of frame components in the setup and collapsed states.
Figure 4B:
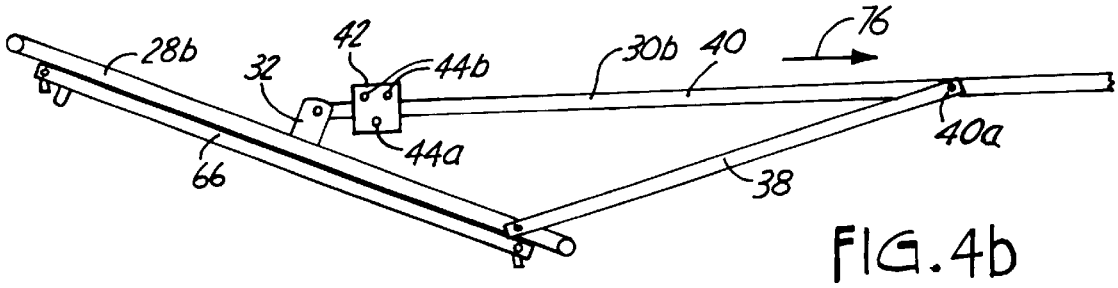

FIGS. 4*a* and 4*b* illustrate how frame 12 collapses for storage. FIGS. 4*a* and 4*b* include end bar 28*b*, cross bar 30*b*, hinge 32, stabilizing bar 38, pole mount 42 with pegs 44*a* and 44*b*, and wheel support 66. FIG. 4*b* additionally includes arrow 76.

FIG. 4*a* shows the position of each part while apparatus 10 is setup for use. While setup, cross bar 30*b* extends perpendicularly from end bar 28*b*, and end bar 28*b*, cross bar 30*b*, and stabilizing bar 38 form a right triangle.

FIG. 4*b* shows the position of each part while apparatus 10 is collapsed for storage. Stabilizing bar 38 is disconnected from cross bar 30*b*, and as cross bar 30*b* pivots at hinge 32 relative to end bar 28*b*, the end of stabilizing bar 38 slides along cross bar 30*b* in the direction shown by arrow 76 and is connected to pin 40*a*. Cross bar 30*b* is no longer perpendicular to end bar 28*b*, and the frame becomes more compressed, which allows it to fit through a doorway for storage in a storage room, for example.

Figure 5:
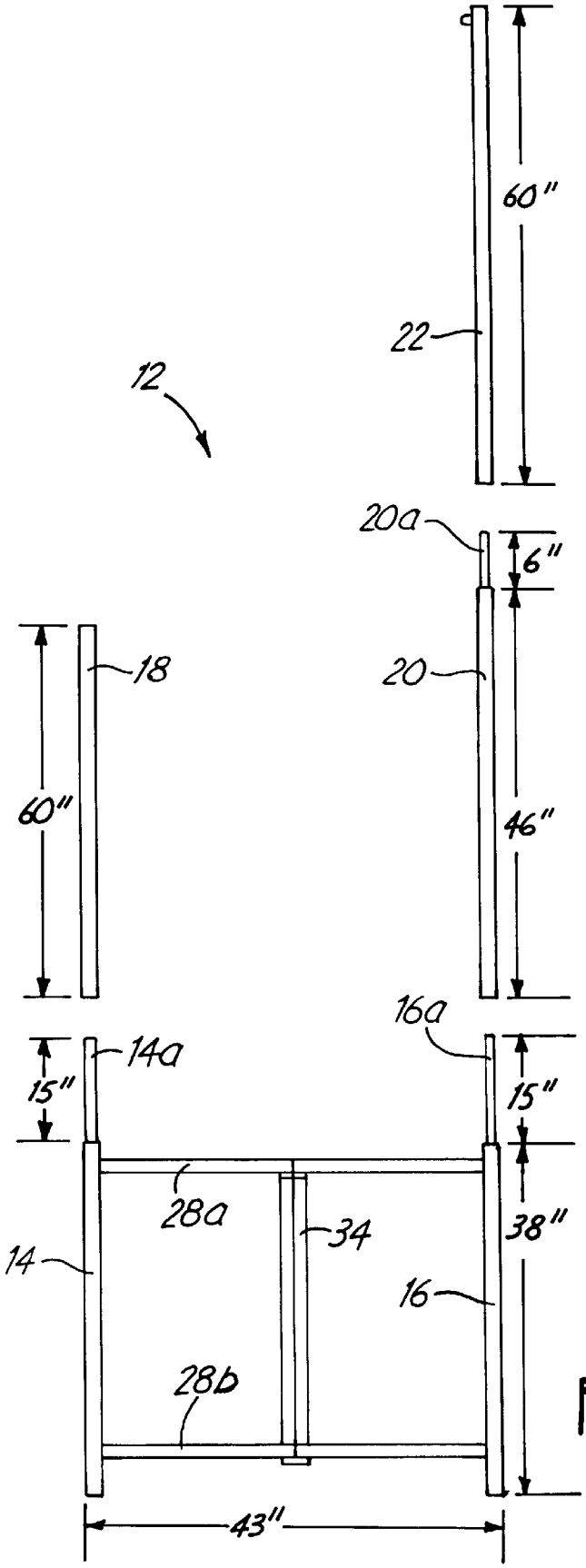
FIG. 5 is an exploded side view showing the basic components of the frame.

FIG. 5 shows how basic parts of frame 12 assemble. FIG. 5 shows frame 12 which includes front post 14 with tubing 14*a* , back post 16 with tubing 16*a*, front pole 18, back pole 20 with tubing 20*a*, back pole 22, end bars 28*a* and 28*b*, and support 34.

To assemble, front pole 18 slides over tubing 14*a* and stacks on to front post 14. The diameter of front post 14 and front pole 18 are equal, while the diameter of tubing 14*a* is smaller. Back pole 20 slides over tubing 16*a* to fit the same way onto back post 16, and back pole 22 fits over tubing 20*a* to fit onto back pole 20.

Preferred dimensions for some of the components of frame 12 are as follows. The width of frame 12 is about 43 inches. Front and back posts 14 and 16 are about 38 inches long with tubing 14*a* and 16*a* about 15 inches long. Front pole 18 is about 60 inches long. Back pole 20 is about 46 inches long with tubing 20*a* about 6 inches long. The length of back pole 22 is about 60 inches.

Figure 6:
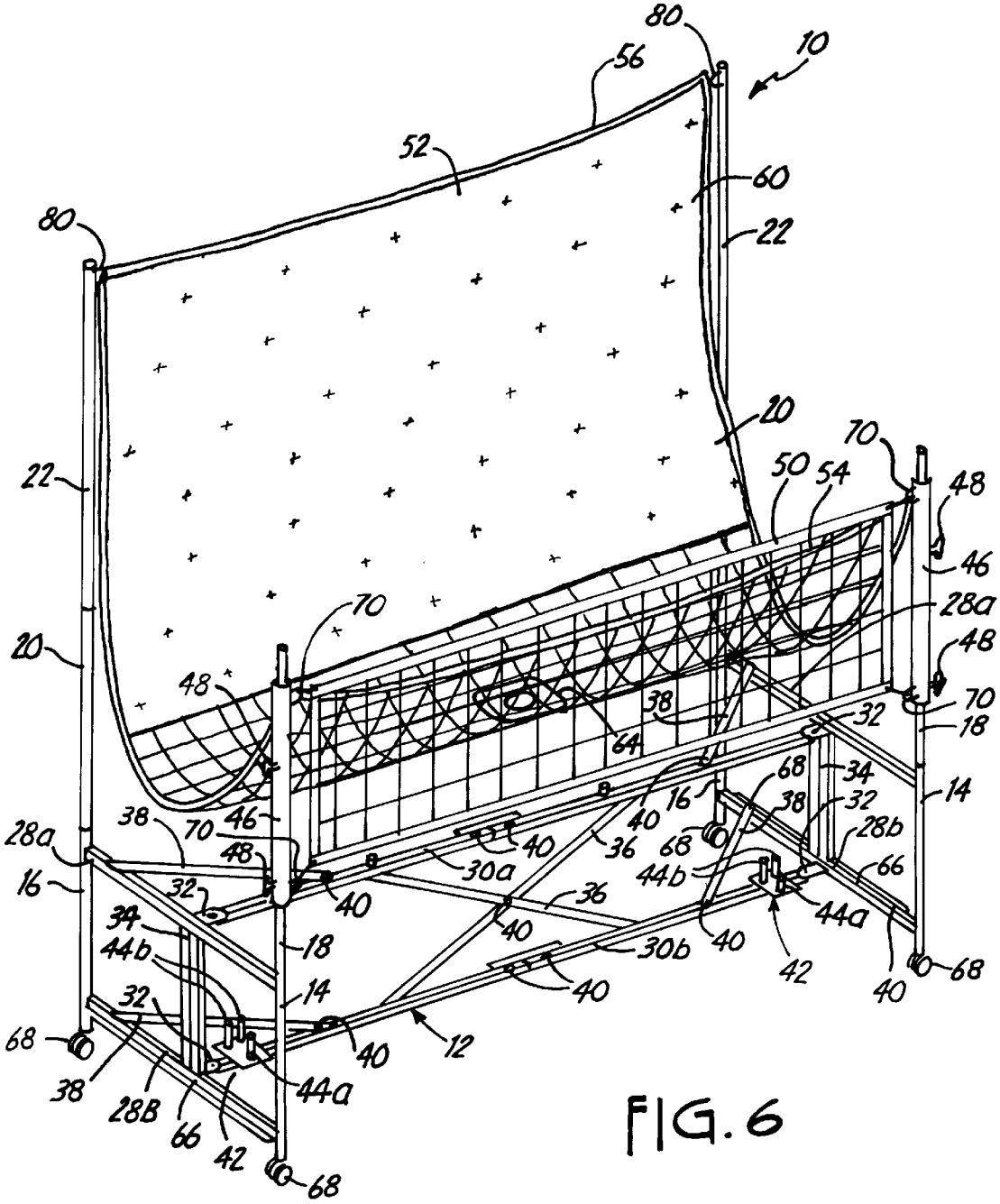
FIG. 6 shows another embodiment of the invention.

FIG. 6 shows another embodiment of the invention, which is generally similar to FIG. 1*a*, with the following exceptions. First, net stabilizers 24*a* and 24*b* and coupler 26 are not used. Second, second net 52 includes only panel 60. Third, the upper comers of panel 60 are connected to eyes or hooks 80 at the upper ends of back poles 22. Fourth, wheels 68 are mounted on the bottom ends of front posts 14 and back posts 16, and wheel supports 66 are eliminated. Fifth, stabilizing bars 38 extend toward the back of frame 12 from cross bars 30*a* and 30*b*.

Figure 7A:
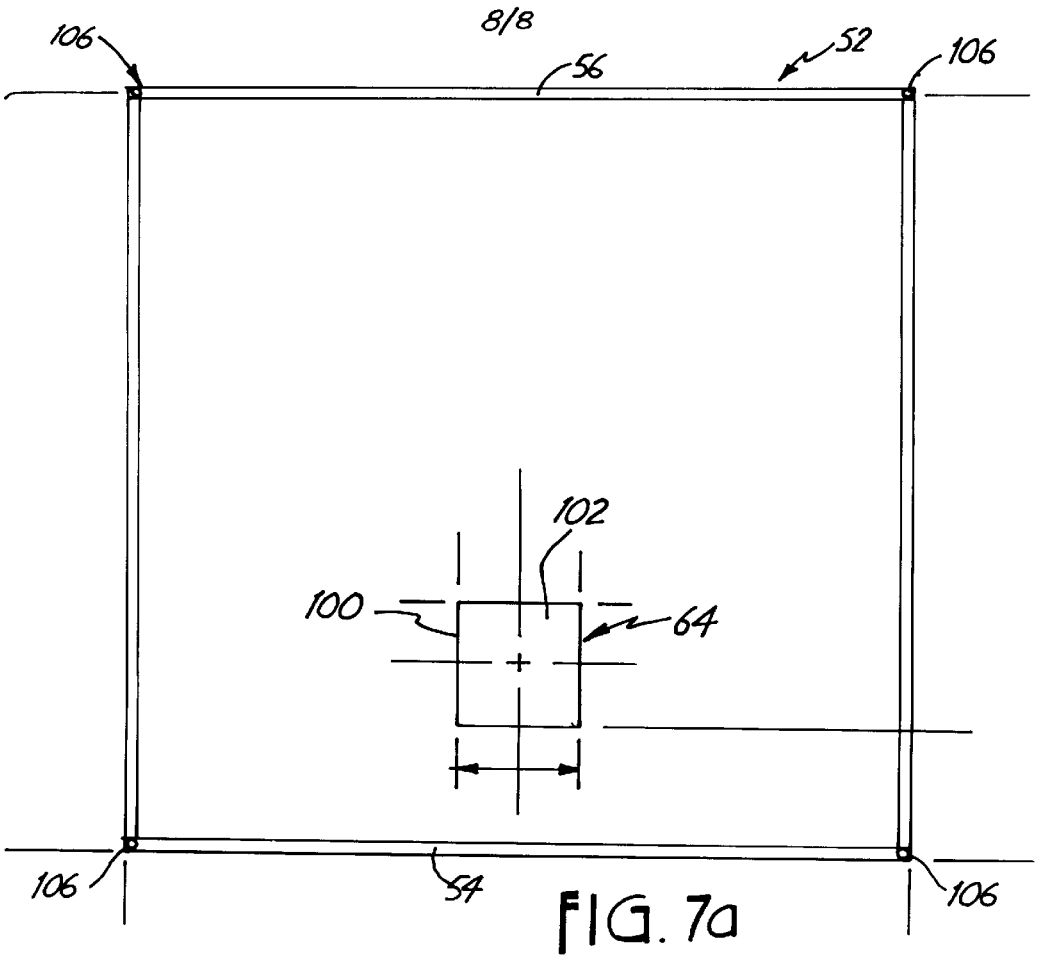
FIGS. 7*a*–7*c* show the second net used in FIG. 6.
Figure 7B:
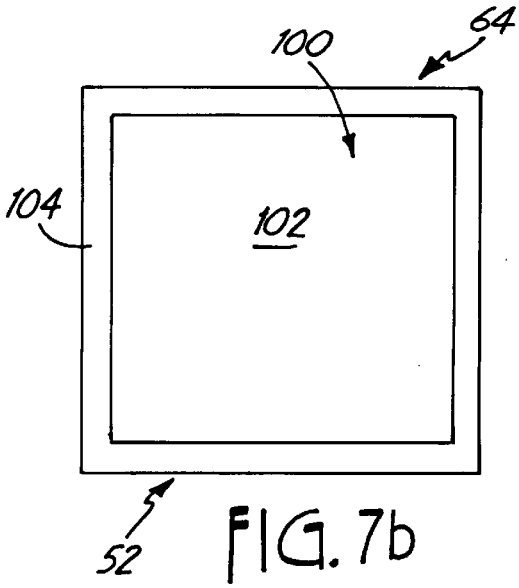
Figure 7C:
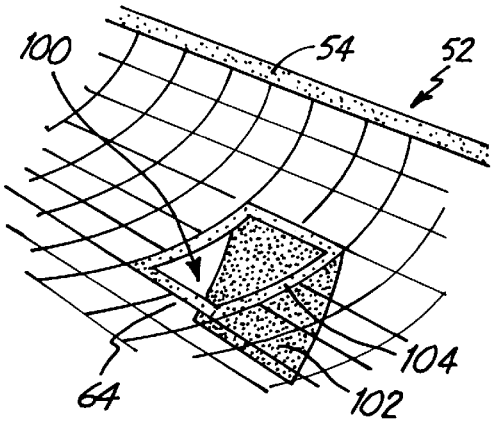

FIGS. 7*a*, 7*b*, and 7*c* show more details regarding second net 52 shown in the embodiment of FIG. 6. In the embodiment shown in FIGS. 7*a*–7*c* ball release 64 is in a form of a square aperture 100 which is covered by a square flap 102. A hook and loop fastener (such as Velcro) material 104 is positioned around opening 100 to hold flap 102 in place. Fastener 104 is preferably sewn in place around the edge of opening 100.

Grommets 106 are positioned in each of the four corners of second net 52 for connection to hooks 70 and 80.

In a preferred embodiment, second net 52 is approximately 9 foot 4 inches square. The forward edge of opening 100 is approximately 30 inches from front edge 54 of second net 52. Opening 102 is approximately 12 inches by 12 inches in dimension and is centered at approximately equal distances from the left and right edges of second net 52. Flap 102 is slightly larger in dimension than the size of opening 100.

Although the present invention has been described with reference to preferred embodiments, workers skilled in the art will recognize that changes may be made in form and detail without departing from the spirit and scope of the invention.

What is claimed is:

1. A volleyball training apparatus comprising:

a frame for positioning on a horizontal surface with front and back support members extending vertically from the horizontal surface;

a first net attached to the front support members and extended across a front of the frame; and a second net attached to the back support members and extended across a back of the frame such that the second net has a vertical portion and a pocket portion.

2. The apparatus of claim 1 wherein the second net is attached to the front support members.

3. The apparatus of claim 1 wherein the back support members are taller than the front support members.

4. The apparatus of claim 1 wherein an edge of the vertical portion of the second net is attached to the back support members at a height above the first net.

5. The apparatus of claim 1 wherein the second net forms a pocket that is positioned to catch and hold volleyballs hit over the first net.

6. The apparatus of claim 1 and further comprising:

height adjustment means on the front and back support members.

7. The apparatus of claim 1 wherein the first net adjusts from about 6 feet to over about 9 feet from a practice surface.

8. The apparatus of claim 1 wherein the second net is attached about 12 feet from the practice surface.

9. The apparatus of claim 1 wherein the volleyball training apparatus is collapsible.

10. The apparatus of claim 1 wherein the frame folds to become essentially flat.

11. The apparatus of claim 1 wherein the front and back support members can be disassembled.

12. The apparatus of claim 1 and further comprising:

a ball release in the second net.

13. The apparatus of claim 1 and further comprising wheels for supporting and allowing rolling movement of the frame.

14. The apparatus of claim 1 and further comprising:

pole mounts with pegs for storing support members.

15. The apparatus of claim 1 and further comprising:

a net stabilizer to prevent balls from being tossed back over the first net.

16. A volleyball training apparatus comprising:

a frame with two front support members and two back support members placed in each corner of the frame, wherein the front support members are connected to the back support members by end bars, the end bars are connected to each other by supports and cross bars with cross stabilizers connecting the cross bars, stabilizing bars connecting between the end bars and the cross bars, pole mounts with pegs attached to the cross bar, adjustable sleeves that slide over and partially cover the front support members, and set screws on the sleeves;

a first net attached to the sleeves and extended across a front of the frame, the sleeves secured in place along the front support members by the set screws; and a second net having a first edge extended across a back of the frame, the second net having a second edge attached to the front support members in such a way that the second net has a vertical portion and forms a pocket behind the first net, the second net having a first and second panel, the second panel draping behind the first panel, and the first panel having a ball release.

17. The apparatus of claim 16 wherein the front and back support members are derived from sections of tubing which fit together to form the supports and can be disassembled.

18. The apparatus of claim 16 wherein the cross bars attach to the end bars by hinges that allow the end bars to pivot relative to the cross bars.

19. The apparatus of claim 16 wherein the first and second nets are detachable from the frame.

20. The apparatus of claim 16 and further comprising:

fasteners that secure components of the frame together.

21. The apparatus of claim 20 wherein the fasteners can be removed to further disassemble the frame.

22. The apparatus of claim 16 wherein the net stabilizer is detachable from the frame and is further disassembled by detaching the coupler.

23. A volleyball training apparatus comprising:

a portable frame for positioning on a horizontal surface having a plurality of support members;

a first net removably attached to and extended between the support members; and a second net removably attached to and extended between the support members;

wherein the first net is smaller than the second net and the second net has a vertical portion and an angled portion.

24. The apparatus of claim 23 wherein the angled portion of the second net forms a pocket.

25. A volleyball training apparatus comprising:

a portable frame for positioning on a horizontal surface having a plurality of support members;

a first net attached to and extended between the support members; and a second net attached to and extended between the support members and behind the first net;

wherein the second net has a vertical portion and a pocket portion.

26. The apparatus of claim 25 wherein the support members are spaced to accommodate up to a standard-sized net.

27. The apparatus of claim 26 wherein the first net is up to a standard-sized volleyball net.

28. A volleyball training apparatus comprising:

a frame for positioning on a horizontal surface with front and back support members extending vertically;

a first net attached to the front support members and extended across a front of the frame;

a second net attached to the back support members and extended across a back of the frame such that the second net has a vertical portion and a pocket portion; and a panel on the second net that drapes behind the frame to prevent balls from being tossed back over the first net.

* * * * *

UNITED STATES PATENT AND TRADEMARK OFFICE

CERTIFICATE OF CORRECTION

PATENT NO. : 6,659,893 B1
DATED : December 9, 2003
INVENTOR(S) : Douglas B. Campbell et al.

It is certified that error appears in the above-identified patent and that said Letters Patent is hereby corrected as shown below:

Column 1,
Line 43, delete “1a” and insert -- 1b --

Column 2,
Line 1, delete “comer” and insert -- corner --

Column 4,
Line 54, delete “comers” and insert -- corners --

Signed and Sealed this

Second Day of March, 2004

JON W. DUDAS
*Acting Director of the United States Patent and Trademark Office*